US006203412B1

(12) United States Patent
Quek

(10) Patent No.: US 6,203,412 B1
(45) Date of Patent: Mar. 20, 2001

(54) SUBMERGE CHEMICAL-MECHANICAL POLISHING

(75) Inventor: Sebastian Ser Wee Quek, Singapore (SG)

(73) Assignees: Chartered Semiconductor Manufacturing Ltd., Singapore (SG); Lucent Technologies, Inc., Allentown, PA (US)

( * ) Notice: Subject to any disclaimer, the term of this patent is extended or adjusted under 35 U.S.C. 154(b) by 0 days.

(21) Appl. No.: 09/443,422

(22) Filed: Nov. 19, 1999

(51) Int. Cl.[7] ..... B24B 1/00

(52) U.S. Cl. ..... 451/60; 451/41; 451/285; 451/287; 451/288; 451/446

(58) Field of Search ..... 451/41, 60, 285, 451/287, 288, 446, 443

(56) References Cited

U.S. PATENT DOCUMENTS

| | | | | |
|---|---|---|---|---|
| 5,605,499 | | 2/1997 | Sugiyama et al. . | |
| 5,709,593 | * | 1/1998 | Guthrie et al. | 451/287 |
| 5,755,614 | * | 5/1998 | Adams et al. | 451/60 |
| 5,791,970 | | 8/1998 | Yueh . | |
| 5,830,043 | | 11/1998 | Aaron et al. . | |
| 5,885,147 | | 3/1999 | Kreager et al. . | |
| 5,886,147 | * | 3/1999 | Kreager et al. | 451/443 |
| 5,897,425 | | 4/1999 | Fisher, Jr. et al. . | |
| 6,106,728 | * | 8/2000 | Iida et al. | 210/743 |

* cited by examiner

*Primary Examiner*—Joseph J. Hail, III
*Assistant Examiner*—Shantese McDonald
(74) *Attorney, Agent, or Firm*—George O. Saile; Rosemary L. S. Pike

(57) ABSTRACT

A new method of chemical mechanical polishing using a submerged polishing table is described. A polishing table is provided having a polishing pad thereon wherein the polishing table is fixed within a container. A channel exists between an outer edge of the polishing table and an inner edge of the container. Outlets lie in a bottom surface of the channel. A wafer carrier presses a wafer onto the polishing pad. Slurry is dispensed onto the polishing pad at a high rate wherein the slurry polishes the wafer and wherein the slurry flushes away particles from a surface of the polishing pad into the container and out through the outlets. Even heavy particles such as diamond bits from a diamond-embedded dresser on the polishing pad can be flushed away using the method and polishing table of the invention.

14 Claims, 1 Drawing Sheet

SUBMERGE CHEMICAL-MECHANICAL POLISHING

BACKGROUND OF THE INVENTION (1) Field of the Invention

The invention relates to a method of polishing in the fabrication of integrated circuits, and more particularly, to a method of improved chemical-mechanical polishing in the manufacture of integrated circuits.

(2) Description of the Prior Art

Chemical-mechanical polishing is used in the art for global planarization of dielectric layers as well as metal layers. A polishing pad having a roughened surface is used to planarize the wafer. During polishing, slurry is used (directly and indirectly) to polish the wafer. After the polishing pad has been used to polish a number of wafers, its surface becomes flattened. The surface can again be roughened by a process known as conditioning. For example, a diamond-embedded wheel or dresser is applied to the pad while the polishing table continues to rotate. Another function of the slurry is to remove particles or any foreign object from the polishing table. Due to the cost of the slurry, the process will call for a minimum amount of slurry to be used during polishing. This is fine when it is used to removed particles, but ineffective when used to remove diamond bits that have fallen off the dresser as the dresser's diamond bits are too heavy to be washed away by the slurry. The diamond bits remaining on the polishing table will scratch the wafers. It is desired to find a process that will remove the heavy particles such as diamond bits from the polishing table.

U.S. Pat. No. 5,885,147 to Kreager et al discloses an apparatus for conditioning a polishing pad. For example, the apparatus may comprise diamond particles. U.S. Pat. No. 5,830,043 to Aaron et al shows a CMP apparatus with built-in pad conditioner. U.S. Pat. No. 5,791,970 to Yueh discloses a slurry recycling system wherein a funnel collects slurry flowing off the platen and filters it for recycling. U.S. Pat. No. 5,709,593 to Guthrie et al discloses a CMP tool with a slurry distribution system. U.S. Pat. No. 5,897,425 to Fisher, Jr. et al shows a vertical polishing device to remove contaminants that may scratch the wafer. U.S. Pat. No. 5,605,499 teaches a CMP process using a two-layer polishing cloth for polishing an interlevel dielectric layer.

SUMMARY OF THE INVENTION

A principal object of the present invention is to provide an effective and very manufacturable method of chemical mechanical polishing.

Another object of the invention is to provide a method of chemical mechanical polishing that avoids scratching of the wafer.

Yet another object is to provide a method of chemical mechanical polishing that avoids scratching of the wafer by removing large particles from the polishing table.

A still further object of the invention is to provide a method of chemical mechanical polishing using a submerged polishing table and high flushing rate to remove large particles from the polishing table.

A still further object of the invention is to provide a method of chemical mechanical polishing using a submerged polishing table and high flushing rate to avoid scratching of the wafer by removing large particles from the polishing table.

Yet another object of the invention is to provide a method of chemical mechanical polishing using a submerged polishing table and a high velocity pump and filters to recycle the slurry.

In accordance with the objects of this invention a new method of chemical mechanical polishing using a submerged polishing table is achieved. A polishing table is provided having a polishing pad thereon wherein the polishing table is fixed within a container. A channel exists between an outer edge of the polishing table and an inner edge of the container. Outlets lie in a bottom surface of the channel. A wafer carrier presses a wafer onto the polishing pad. Slurry is dispensed onto the polishing pad at a high rate wherein the slurry polishes the wafer and wherein the slurry flushes away particles from a surface of the polishing pad into the container and out through the outlets. Even heavy particles such as diamond bits from a diamond-embedded dresser on the polishing pad can be flushed away using the method and polishing table of the invention.

BRIEF DESCRIPTION OF THE DRAWINGS

In the accompanying drawings forming a material part of this description, there is shown.

DESCRIPTION OF THE PREFERRED EMBODIMENTS

Figure 1:
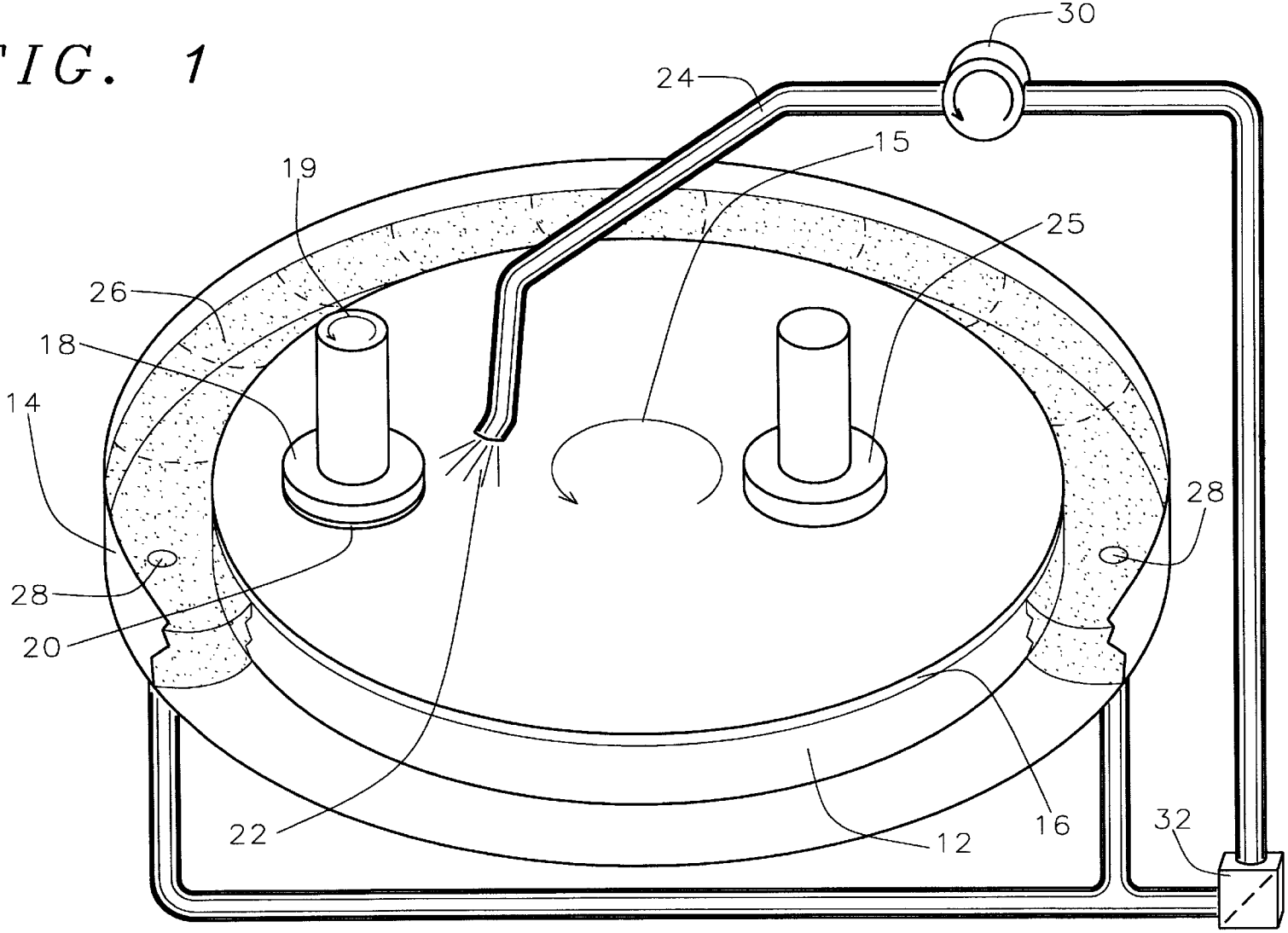
FIG. 1 schematically illustrates in cross-sectional representation a submerged polishing table of the present invention.

Referring now more particularly to FIG. 1, there is illustrated the submerged polishing table of the present invention. Polishing table 12 is submerged within a container 14. The container has a larger diameter than does the polishing table. The table rotates 15 during polishing. A polishing pad 16 sits on the polishing table. A wafer carrier 18 presses a wafer 20 onto the polishing pad. The carrier rotates 19 to polish the wafer. A slurry 22 is dispensed through slurry supply line 24 onto the polishing pad 20. Diamond dresser 25, used to condition the pad as necessary, is shown.

The slurry 22 is dispensed at a high rate of flushing, for example, at more than about 1 foot per second and preferably, at about 3 feet per second. The slurry 26 then collects in the container 14 surrounding the polishing table 12 and is drained out of the container through outlets 28. The channel within the container surrounding the polishing table 12 may be between about 10 and 30 mm wide. The depth of the slurry 26 within the channel may be more than about 1 mm deep. The high rate of flushing and the reservoir of slurry 24 easily flushes away even the heavy diamond bits from the dresser 25, preventing stray diamond bits from scratching the wafer.

Also, according to the invention, the slurry can be recycled to be used for a certain number of wafers before a new batch is introduced, thus keeping the slurry cost in a reasonable range. A high velocity pump 30 and filters 32 are used to recycle the slurry. The pump 30 should be able to pump a minimum of up to 3 liters/minute. The flow rate through the filters 32 should be about 1 foot per second.

The process of the present invention uses a submerged polishing table and a high rate of flushing of the slurry to remove any particles from the polishing table. This process will remove even heavy particles such as diamond bits that fall off a diamond dresser. The slurry can be recycled for a certain number of wafers before having to be replaced in order to keep costs to a minimum.

While the invention has been particularly shown and described with reference to the preferred embodiments thereof, it will be understood by those skilled in the art that various changes in form and details may be made without departing from the spirit and scope of the invention.

What is claimed is:

1. A method of chemical mechanical polishing comprising:

providing a polishing table having a polishing pad thereon wherein said polishing table is fixed within a container wherein a channel exists between an outer edge of said polishing table and an inner edge of said container and wherein outlets lie in a bottom surface of said channel;

providing a wafer carrier to press a wafer onto said polishing pad; and dispensing slurry onto said polishing pad at a rate of velocity of more than one foot per second wherein said slurry polishes said wafer and wherein said slurry flushes away particles from a surface of said polishing pad into said container and out through said outlets.

2. The method according to claim 1 wherein said slurry is dispensed at a high rate of velocity of more than about three feet per second.

3. The method according to claim 1 further comprising providing a diamond-embedded dresser over said polishing pad wherein said particles include diamond bits from said diamond-embedded dresser.

4. The method according to claim 1 further comprising recycling said slurry for a certain number of said wafers before replacing said slurry.

5. A method of chemical mechanical polishing comprising:

providing a polishing table having a polishing pad thereon wherein said polishing table is fixed within a container wherein a channel exists between an outer edge of said polishing table and an inner edge of said container and wherein outlets lie in a bottom surface of said channel;

providing a wafer carrier to press a wafer onto said polishing pad;

providing a diamond-embedded dresser on said polishing pad for conditioning said polishing pad; and dispensing slurry onto said polishing pad at a rate of velocity of more than one foot per second wherein said slurry polishes said wafer and wherein said slurry flushes away particles from a surface of said polishing pad into said container and out through said outlets and wherein said particles include diamond bits from said diamond-embedded dresser.

6. The method according to claim 5 wherein said slurry is dispensed at a high rate of velocity of more than about three feet per second.

7. The method according to claim 5 further comprising recycling said slurry for a certain number of said wafers before replacing said slurry.

8. A method of chemical mechanical polishing comprising:

providing a polishing table having a polishing pad thereon wherein said polishing table is fixed within a container wherein a channel exists between an outer edge of said polishing table and an inner edge of said container and wherein outlets lie in a bottom surface of said channel;

providing a wafer carrier to press a wafer onto said polishing pad;

dispensing slurry onto said polishing pad at a rate of more than one foot per second wherein said slurry polishes said wafer and wherein said slurry flushes away particles from a surface of said polishing pad into said container and out through said outlets; and recycling said slurry for a certain number of said wafers before replacing said slurry.

9. The method according to claim 8 further comprising providing a diamond-embedded dresser over said polishing pad wherein said particles include diamond bits from said diamond-embedded dresser.

10. A chemical mechanical polishing apparatus comprising:

a polishing table having a polishing pad thereon wherein said polishing table is fixed within a container wherein a channel exists between an outer edge of said polishing table and an inner edge of said container and wherein outlets lie in a bottom surface of said channel;

a wafer carrier to press a wafer onto said polishing pad; and means for dispensing slurry onto said polishing pad at a rate of velocity of more than one foot per second wherein said slurry polishes said wafer and wherein said slurry flushes away particles from a surface of said polishing pad into said container and out through said outlets.

11. The apparatus according to claim 10 further comprising a diamond-embedded dresser over said polishing pad wherein said particles include diamond bits from said diamond-embedded dresser.

12. The apparatus according to claim 10 further comprising means for recycling said slurry for a certain number of said wafers before replacing said slurry.

13. The apparatus according to claim 10 wherein said means for dispensing said slurry comprise piping and a high velocity pump.

14. The apparatus according to claim 12 wherein said means for recycling said slurry comprise filters and a high velocity pump.

* * * * *